US006793862B2

(12) United States Patent
Restani

(10) Patent No.: US 6,793,862 B2
(45) Date of Patent: Sep. 21, 2004

(54) METHOD OF MANUFACTURING AN ALPINE SKI

(75) Inventor: Eric Restani, Voiron (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 10/202,766

(22) Filed: Jul. 25, 2002

(65) Prior Publication Data

US 2003/0020258 A1 Jan. 30, 2003

(30) Foreign Application Priority Data

Jul. 25, 2001 (FR) ..... 01 09951

(51) Int. Cl.[7] ..... B29C 45/44

(52) U.S. Cl. ..... 264/261; 264/313; 264/318; 264/328.1; 264/334; 425/DIG. 58

(58) Field of Search ..... 264/264, 278, 264/261, 317, 259, 328.1, 334, 313, 318, 328.11, 263; 249/63, 64; 425/DIG. 58, 112, 127, 123, 450.1, 577; 280/602, 809, 816, 610; 441/68, 74

(56) References Cited

U.S. PATENT DOCUMENTS

| | | | | | |
|---|---|---|---|---|---|
| 2,196,925 | A | | 4/1940 | Kairis | |
| 3,940,157 | A | * | 2/1976 | Sakuma | 280/610 |
| 4,634,140 | A | * | 1/1987 | Stroi | 280/610 |
| 4,889,480 | A | * | 12/1989 | Nakamura et al. | 425/577 |
| 4,919,447 | A | * | 4/1990 | Jackson et al. | 280/604 |
| 4,974,867 | A | * | 12/1990 | Rullier et al. | 280/607 |
| 5,141,243 | A | * | 8/1992 | Meatto | 280/602 |
| 5,346,244 | A | | 9/1994 | Le Masson | 280/607 |
| 5,427,400 | A | * | 6/1995 | Bejean | 280/602 |
| 5,871,224 | A | * | 2/1999 | Vance | 280/608 |
| 5,915,719 | A | * | 6/1999 | Bauvois | 280/607 |
| 6,059,308 | A | * | 5/2000 | Baudin et al. | 280/610 |
| 6,499,758 | B1 | * | 12/2002 | Fournier | 280/609 |
| 6,547,210 | B1 | * | 4/2003 | Marx et al. | 249/175 |

FOREIGN PATENT DOCUMENTS

DE 29511954 U1 9/1995

* cited by examiner

*Primary Examiner*—Leo B. Tentoni
*Assistant Examiner*—Monica A. Fontaine
(74) *Attorney, Agent, or Firm*—Heslin Rothenberg Farley & Mesiti P.C.; Victor A. Cardona, Esq.

(57) ABSTRACT

The invention relates to a method of manufacturing a ski (1) comprising at least one binding-raising zone (5) formed by an extra thickness of the structure of the ski forming a projection in the region of the zone of the runner (2). Such a ski has a groove (12) let in over at least a portion of the length of each of its lateral faces, said groove (12) being located between the upper face (6) of the raising zone (5) and the edge (9) of the ski.

7 Claims, 5 Drawing Sheets

Fig. 2
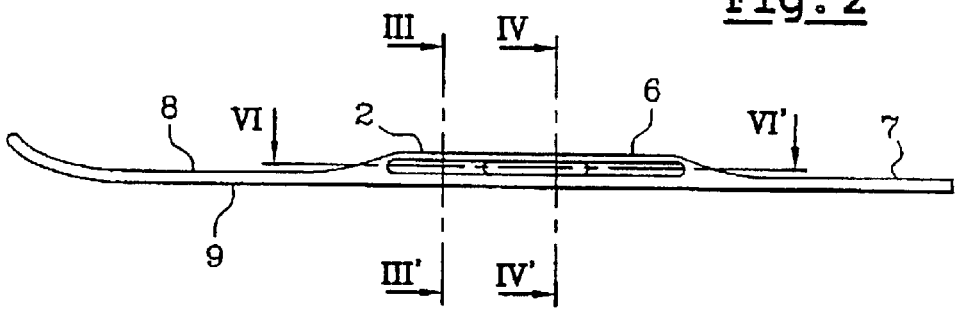
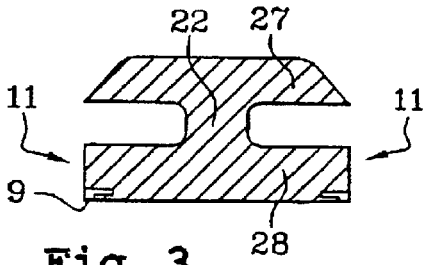
Fig. 3
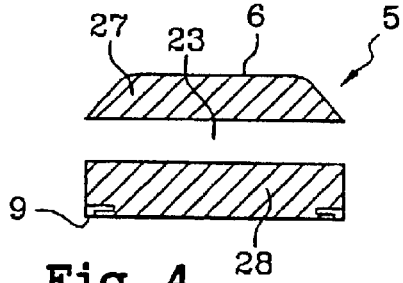
Fig. 4
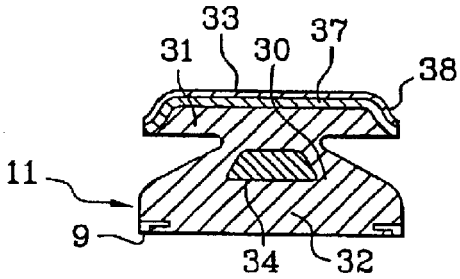
Fig. 5
Fig. 6
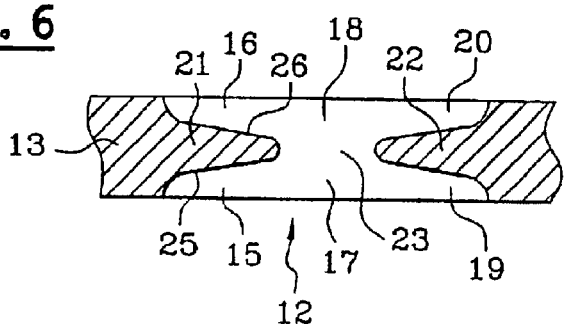

METHOD OF MANUFACTURING AN ALPINE SKI

CROSS REFERENCE TO RELATED APPLICATIONS

This application claims priority from French patent application FR 01 09951, filed on Jul. 25, 2001, the entire disclosure of which is incorporated herein by reference.

TECHNICAL FIELD

The invention relates to the field of sports involving sliding, to be more precise an alpine ski. More particularly, it relates to a ski which comprises a binding-raising zone formed by an extra thickness of the structure itself of the ski. The invention makes it possible to optimize the mechanical properties of a ski having such a structure. The invention also relates to a method which makes it possible to manufacture such skis.

PRIOR ART

Generally, the upper face of the ski is provided, in the zone of the runner, with a safety binding consisting of a stop and a heelpiece. For various reasons, in particular for facilitating the tipping of the ski from one edge onto the other, it is desired to elevate the elements of the binding in relation to the sole of the ski. This elevation can be achieved in various ways, for example by using a raising platform screwed, or more generally joined, to the upper face of the ski. A great many types of platform have already been proposed, such as in particular that described in document U.S. Pat. No. 5,879,019.

It has also been proposed to elevate the binding not by using an additional element attached to the ski but, on the contrary, by designing the structure of the ski in such a manner that it has an extra thickness which itself forms the raising zone. Thus, in document FR 2 718 650, a ski has been described, the structure of which comprises, in the region of the runner zone, an additional element elevating the upper face of the ski in relation to the zones of the tip and of the heel. This elevated portion forms a raising zone, on which the stop and the heelpiece are mounted. Another example of a raising zone produced by virtue of a special design of the structure itself of the ski is described in document FR 2 686 520, which corresponds to document U.S. Pat. No. 5,346,244.

It is clear that this raising zone formed by the structure has a major influence on the mechanical properties of the ski, giving rise in particular to considerable stiffening of the zone of the runner. One object of the invention is to modulate this influence so as to obtain a ski which can be optimized in terms of its dynamic behavior.

In document U.S. Pat. No. 2,196,925, a particular ski has been described, which has an elevated runner zone which is machined. To be more precise, the upper face of the runner zone comprises several through-slots which open into cavities let in laterally. In this way, the wedge of snow present under the sole of the boot is removed via the slots, in particular when it melts. The production of such skis is relatively complex, of course, because it calls for very specific machining operations which make the structure of the ski fragile and are incompatible with modern manufacturing techniques and composite structures.

DISCLOSURE OF THE INVENTION

The invention therefore relates to a method of manufacturing an alpine ski which comprises at least one binding-raising zone formed by an extra thickness of the structure of the ski forming a projection in the region of the zone of the runner. The ski may comprise a single raising zone which receives the two elements of the binding. This raising zone can also be divided into two parts, a first part receiving the stop, the other part the heelpiece. In certain types of design, only the stop, or indeed the heelpiece, may be mounted on a raising zone. In this method, the various component elements of the ski are, in a conventional manner, positioned in a mold, between a mold bottom and a mold cover.

The method as claimed in the invention is characterized in that:

- before molding, additional elements extending into the mold are arranged above the bottom of the mold, between the bottom and the cover, and above each lateral face of the ski;
- after molding, said additional elements are, at least in part, removed so as to form grooves in the lateral faces of the ski.

In other words, the characteristic grooves are obtained by, after molding, extracting the additional elements which project beyond the sides of the ski. These additional elements, if appropriate in the form of a wedge, are easy to extract because they have been positioned in the mold with a large zone protruding laterally.

In practice, the additional elements can be removed either in totality or in part after molding. Thus, if these additional elements are made of a relatively flexible and deformable material, they can be extracted by pulling out. When the elements are more rigid, they can be removed by machining. The grooves are then formed inside these additional elements.

According to the invention, the ski obtained in accordance with such a method therefore has a groove let in over at least a portion of the length of each of its lateral faces. This groove is located between the upper face of the raising zone and the edge of the ski.

In the region of the raising zone, on its lateral flanks, the ski comprises let-in portions which can extend over all or part of the length of the raising zone. These grooves can be produced in the raising zone itself, that is to say above the level at which the ski would lie if it did not comprise the raising zone. These grooves can also be located below this level, above the edges. The presence of these grooves, which form cavities, and in particular their length and their depth, influences the overall rigidity of the structure, in particular in the region of the zone of the runner. The behavior can thus, for example, resemble more closely that of a conventional ski provided with a platform attached to its upper face, while retaining the advantages of a raising zone integrated into the structure of the ski, in particular lightening.

In practice, the additional elements used in the manufacturing method can advantageously be parallel to the sole of the ski, so as to provide grooves essentially parallel to the upper face of the raising zone.

In a particular embodiment, the additional elements used in the method can be positioned so as to come into contact with one another. They thus make it possible to produce a through-zone when they are subsequently removed. This contact zone between the additional elements can be arranged in any region of the raising zone, preferably in the central region thereof.

In other words, the grooves let in on each of the lateral faces can meet to define, over at least part of their length, at least one opening passing through transversely below the upper face of the raising zone. In other words, the groove produced on one side of the ski is let in sufficiently deeply to open into the groove produced on the other side, and thus to form a zone free of material over the entire width of the ski.

These through-openings can also be produced independently of the characteristic grooves.

In practice, the through-opening is advantageously located longitudinally, essentially in the central region of the raising zone. In other words, the hollowed-out zone produced in or under the raising zone is situated between the zones receiving the stop and the heelpiece of the binding.

In practice, the bottoms of the opposite grooves define between them an essentially vertical partition located below the upper face of the raising zone. In other words, the structure of the ski comprises a region of a width smaller than the width of the ski, on which region a part of the raising zone lies. This region therefore forms a partition on which the upper part of the raising zone lies and via which the bearing forces are transmitted. This partition contributes to the overall rigidity of the raising zone, the design of which is moreover lightened by the presence of the characteristic grooves.

In a preferred embodiment, the ski comprises a through-opening and two partitions as described above, these partitions being located one in front of and one behind the through-opening. The partitions can thus advantageously be situated longitudinally straight below one of the elements of the binding, so as to allow good transmission of the forces in the direction of the sole of the ski.

The shape of the various partitions formed between the grooves can be different. Thus, these partitions can have a thickness, measured transversely in relation to the ski, which either is essentially constant or varies. To be more precise, the cross section of the partition can either be constant or develop in the direction of the length of the ski. In the latter case, this thickness may decrease to reach a minimum in the region of the limits of the hollowed-out through-zone.

The width of the partitions measured transversely can also vary with the height of the partition. In other words, this partition can have flanks which are not strictly vertical but, on the contrary, inclined. Thus, in a particular embodiment, the partition can, over at least a fraction of its length, extend in its lower part to close to the lateral faces of the ski, so as to contribute to the transmission of the bearing forces in the direction of the edges. In other words, in their upper part, the partitions have a relatively reduced width. This partition widens out in the downward direction, so as to have an essentially trapezoidal cross section. This design makes it possible to lighten the raising zone without impairing the vertical transmission of the bearing forces.

In certain particular embodiments, the partition can include at least one element made of a material which is lighter than the rest of the ski, so as to reduce the influence of the raising zone on the weight and the overall rigidity of the ski.

In practice, the upper part of the raising zone can advantageously include at least one rigid insert which is capable of receiving the screws for mounting the binding. This insert, located below the upper face of the raising zone, is made from a material which can receive the screws for mounting the binding with minimum risk of thread-stripping.

In practice, the grooves produced on the lateral faces of the ski can allow the positioning of particular binding elements. These elements are advantageously adapted so as to interact with the characteristic grooves produced in the ski. These grooves can therefore serve for holding the stop and/or the heelpiece in position and for the longitudinal adjustment of the position of these elements. Thus, when these grooves are parallel to the upper face of the raising zone, they can receive ribs oriented toward the median longitudinal plane of the ski, which are formed under a sliding block supporting the stop or the heelpiece.

In a particular embodiment, at least one safety binding element is mounted by means of a clamp system including lateral jaws interacting with the complementary lateral grooves of the ski. These jaws are advantageously held in position transversely on the ski by locking means.

BRIEF DESCRIPTION OF THE FIGURES

The invention and the advantages afforded by it will emerge clearly from the description of the embodiments below based on the accompanying figures, in which:

FIG. 2 is a side view of the ski in FIG. 1,

FIGS. 3 and 4 are sectional views along the planes III–III' and IV–IV' in FIG. 2, FIG. 5 is a sectional view similar to FIG. 3, showing a variant embodiment, FIG. 6 is a sectional view along a plane VI–VI' in FIG. 2, FIGS. 7 to 12 are sectional views of a ski shown as the sequence of the stages of the production method as claimed in the invention proceeds, and of some variant embodiments.

MODE FOR CARRYING OUT THE INVENTION

As already mentioned, the invention relates to both an alpine ski having a binding-raising zone forming an integral part of the structure of the ski, and a manufacturing method making it possible to obtain such a ski.

Figure 1:
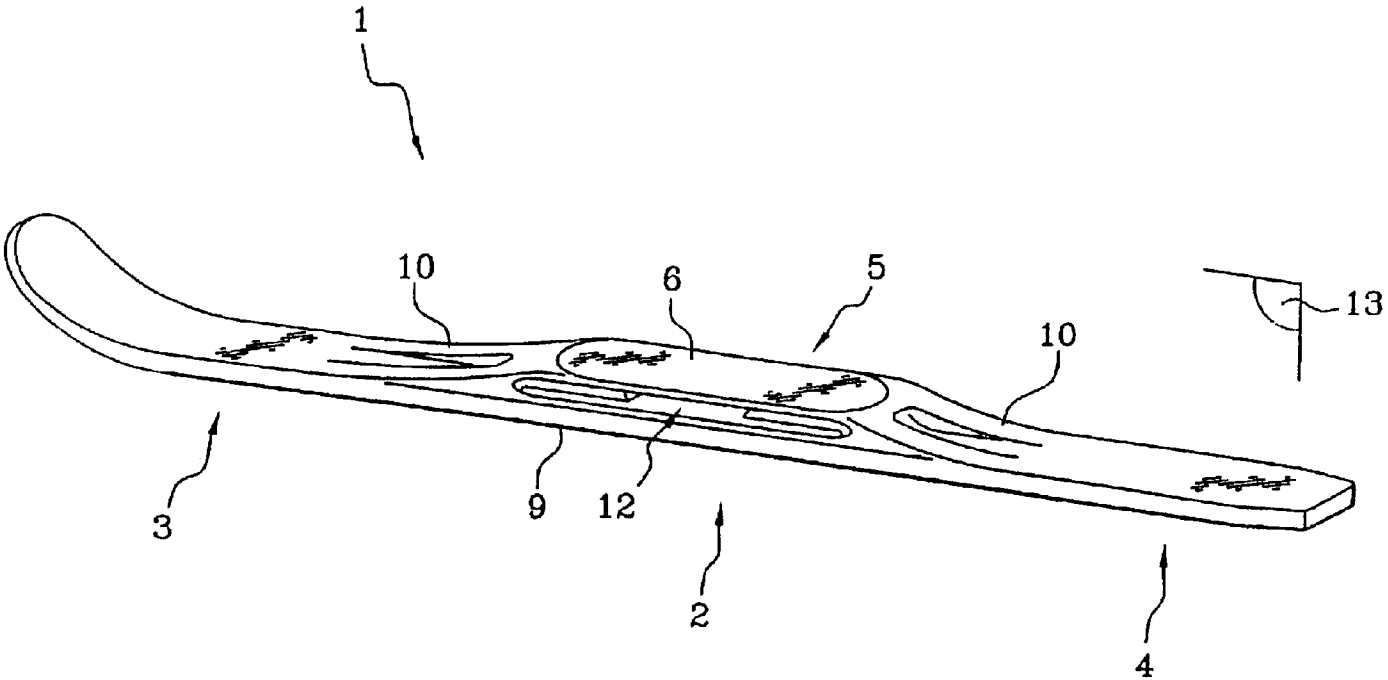
FIG. 1 is a basic perspective view of a ski as claimed in the invention.

Such a ski (1) is illustrated in FIG. 1 and has, in a known manner, a runner zone (2), a tip zone (3) and a heel zone (4). In the region of the runner zone (2), the ski (1) comprises a zone for raising the binding (5), which is formed by a projection of the structure itself of the ski. The upper face (6) of this raising zone (5) determines an extra thickness of the ski in relation to the edges (9), which is more accentuated at the runner than in the heel zone (4) or in the tip zone (3). The upper face (6) of the raising zone (5) is intended to receive the stop and the heelpiece of the binding.

Additionally, as illustrated in FIG. 1, this raising zone (5) may comprise extensions (10) forming arms extending in front of and behind the actual raising zone (5) itself.

According to the invention, the ski (1) comprises, on each of its lateral faces (11), at least one groove (12) let in in the direction of the median longitudinal plane (13) of the ski. This groove (12) can, like the embodiment illustrated in FIGS. 1 and 2, extend over virtually the entirety of the length of the raising zone (5). It can also extend over only a part of this raising zone, or over the entirety of the length, and open at the front and at the rear of the raising zone (5).

According to a characteristic of the invention, the grooves (12) can be parallel to the upper face (6) of the raising zone (5). They are then parallel to the sole of the ski. These grooves (12) can be located at different heights between the edges (9) and the upper face (6) of the raising zone (5). In the embodiment illustrated, the groove (12) is located at a height which is slightly greater than the thickness of the ski measured in the heel and tip zones. Nevertheless, these grooves could be located at a slightly lower level, closer to the edges (9).

According to a characteristic of the invention, and as illustrated in FIG. 6, each groove (12) can comprise various zones (15–20) having a depth which differs. Thus, in the front parts (15, 16) and rear parts (19, 20) of the groove (12), the latter has a depth which is less than half the width of the ski, so that the bottoms (25, 26) of the grooves define a partition (21, 22) connecting the upper part (27) of the raising zone (5) to the bottom part (28) of the structure of the ski. In the embodiment illustrated in FIGS. 2 and 6, the grooves (12) define two partitions (21, 22) located essentially straight below the zones intended to receive the stop and the heelpiece of the binding. Between the two partitions (21, 22), the portions (17, 18) of the groove (12) meet to form a through-opening (23). This through-opening is located essentially in the median region of the raising zone (5).

In the embodiment illustrated in FIG. 6, the partitions (21, 22) have a width which varies in the direction of the length of the ski. The bottoms (25, 26) of the portions (15, 16, 19, 20) of the groove (12) are not parallel to the edges (9) of the ski but, on the contrary, have a certain inclination in relation to the median plane (13) of the ski. Adjustment of this width variation of the partitions (21, 22) makes it possible to modify as desired the influence of the rigidity of the raising zone (5) on the rest of the structure of the ski. Thus, when these partitions (21, 22) have a very small width, slight transverse bending of the ski is favored. Conversely, when the grooves (12) are let in to a relatively lesser extent, the partitions (21, 22) affect the overall rigidity of the ski more appreciably.

The length of the through-zone (23) is also determined in order to optimize the dynamic behavior of the ski, while lightening its structure.

The influence of the rigidity of the raising zone can also be adjusted by the selection of a particular section or profile as far as the partitions (21, 22) are concerned.

Thus, in the embodiment illustrated in FIG. 5, the partition (30) has a trapezoidal section overall. The partition (30) therefore has a smaller width in its top part. This small width modifies the bending rigidity of the upper part (31) of the raising zone (5) to allow slight deflection of this upper zone (31) about the longitudinal axis of the ski. Conversely, in its bottom part, the partition (30) joins the section of the bottom part (32) of the structure of the ski. In this way, the bearing forces exerted on the upper face (33) of the raising zone (5) are effectively transmitted in the direction of the edges (9) to favor the edge grip.

As illustrated in FIG. 5, the partition (30) can incorporate various types of insert, which afford it particular mechanical properties. Thus, for the purpose of lightening, it is possible to incorporate an insert (34) made of a material of low density, of the cellular or honeycomb type.

As the upper zone (31) of the raising zone (5) is intended to receive the stop and the heelpiece, it is advantageously possible, as FIG. 5 illustrates, to integrate into it a reinforcement (37) making it possible to rigidify it. This reinforcement (37), arranged below the upper protection face (38), can be perforated and receive the screws for mounting the elements forming the binding.

In an embodiment which is not shown, the ski can comprise two zones for raising the binding, a first receiving the stop, the other receiving the heelpiece. In a particular embodiment, only one of the binding elements, for example the stop, can be mounted on a binding-raising zone, the other element, typically the heelpiece, being mounted on a conventional raising platform.

As already mentioned, the invention also relates to a method which makes it possible to manufacture a ski according to the invention.

As illustrated in FIGS. 7 to 12, this method can link the following different stages.

Figure 7:
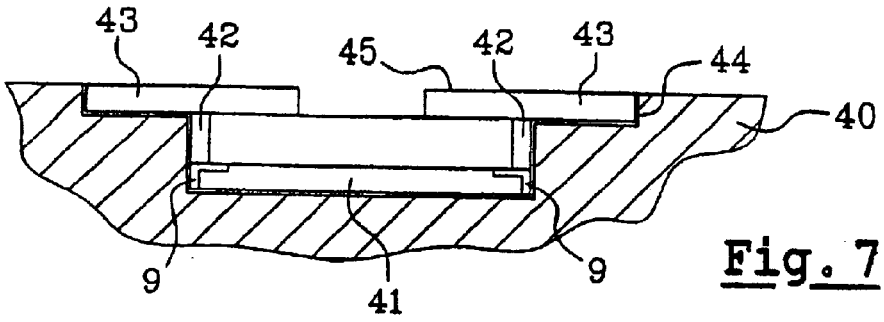
Figure 8:
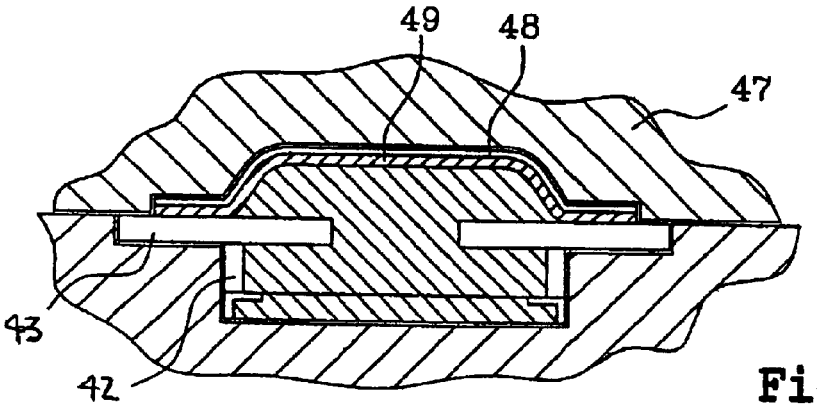

To begin with, as illustrated in FIG. 7, the various elements serving to produce the bottom part of the structure of the ski are positioned in a mold bottom (40), in particular the edges (9), the sole (41) and the lateral reinforcement elements (42) intended to form the sides of the ski. Then, two additional elements (43) are positioned above the lateral reinforcement elements (42). These additional elements lie on a shoulder (44) produced in the bottom (40) of the mold. These elements (43) protrude inside the structure of the ski with a portion (45) which can extend to a greater or lesser depth according to the depth it is desired to give to the characteristic grooves. The rest of the structure intended to form the ski has not been shown as this may involve either preformed elements intended to form the core or various reinforcements which have no influence on the other characteristics of the invention. The ski can also be produced by injection of constituents which react in situ to form a core made of polyurethane.

In a second stage, after having arranged the characteristic additional elements (43), the mold cover (47) is positioned, after having applied a sheet (48) intended to form the upper protection layer. This sheet (48) may be associated with a reinforcement element (49), typically made of glass fibers impregnated with epoxy resin, which will serve to anchor the screws for mounting the elements of the binding.

Figure 9:
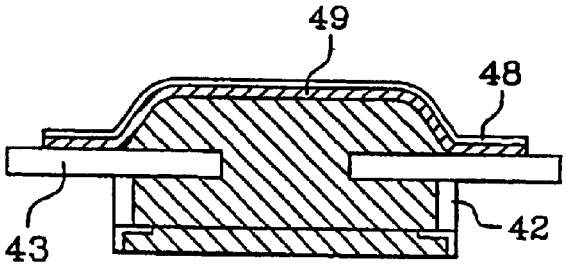
Figure 10:
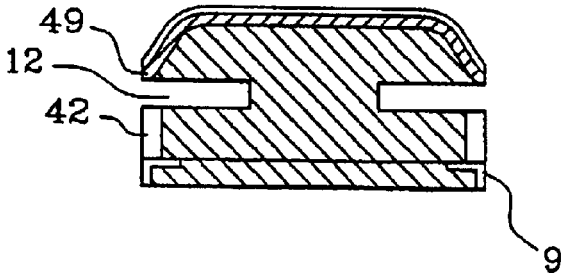

After molding, whichever type of process is used, the assembly thus produced is removed from the mold. The structure illustrated in FIG. 9 is thus obtained. The additional elements (43), as well as part of the upper sheet (48), protrude laterally from the final shape of the ski. The layer (48) is then cut away to the limits of the upper portion of the raising zone. According to the invention, the elements (43) are then extracted. As illustrated in FIG. 10, they thus define two characteristic grooves (12).

Figure 11:
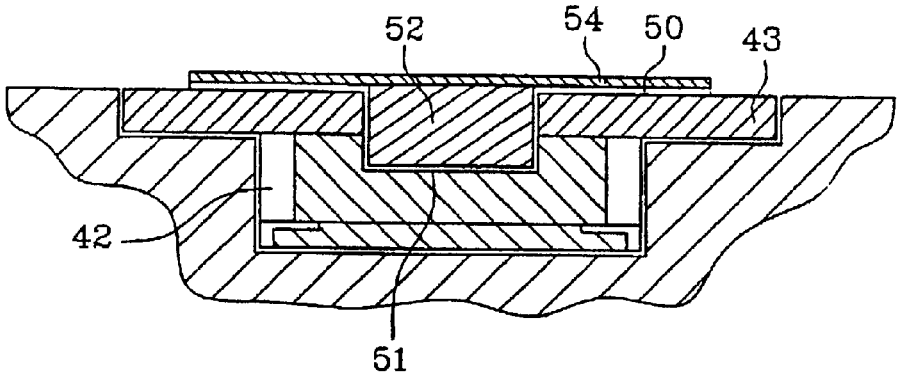
Figure 12:
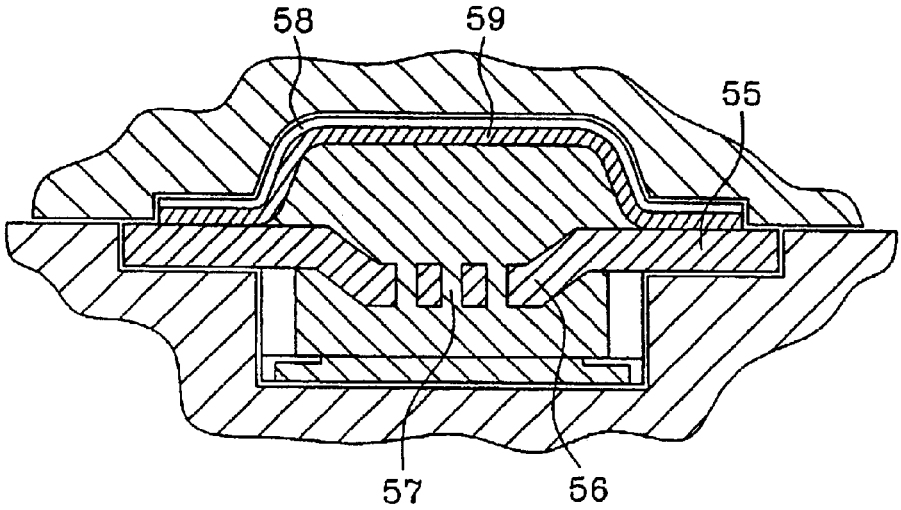

The method according to the invention can be carried out according to other variants, such as those illustrated in FIGS. 11 and 12.

Thus, in a first variant ski of rectangular section illustrated in FIG. 11, the additional elements (43) are positioned in the mold bottom (40) above the lateral reinforcement elements (42). Above these additional elements (43), a metal sheet (50) is positioned, which also protrudes laterally from the structure of the ski. This sheet (50) is folded in its center to form a housing (51) let into the structure of the ski between the additional elements (43). This housing (51) receives a filling element (52) which will form the main part of the characteristic partition. This metal sheet (50) is then covered by a layer of plastic material (54) which will form the upper protection layer. It is possible to add a fibrous reinforcement element (not shown) between the metal insert (50) and the protection layer (54).

After molding, the additional elements (43) are removed. The metal sheet (50) and the protection layer (54) are then made flush in the region of the lateral reinforcement elements (42). The metal layer (50) can advantageously be threaded to receive the screws for mounting the bindings.

In another variant embodiment, illustrated in FIG. 12, use is made of an additional piece (55) which is positioned in the bottom (40) of the mold above the lateral reinforcement elements (42). This additional element (55) can have in its center a zone in the form of a depression (56) to balance the upper and lower parts of the structure and to facilitate positioning of the various elements when they are put into the mold. In the bottom of this depression (56), openings (57) are made, which are intended to allow the passage of the polyurethane foam when the latter expands after injection of the liquid mixture of the reactive chemical constituents. As it expands, this foam flattens the upper protection layer (58) and the associated reinforcement (59) under the cover of the mold. After removal from the mold, those portions of the upper protection layer (58) and the characteristic piece (55) which protrude laterally from the final structure of the ski are made flush. The piece (55) made of plastic material can then be machined to produce the characteristic grooves with the desired depth.

Figure 13:
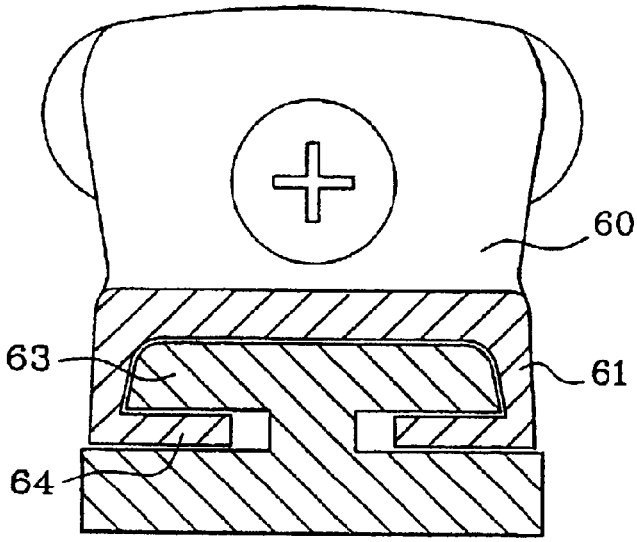
FIGS. 13 and 14 are views in cross section illustrating the mounting of one of the elements of the binding on the ski as claimed in the invention.

The ski thus obtained therefore has a raising zone provided with lateral grooves over all or part of its length. This raising zone can receive the various elements of the binding, which are then screwed through its upper face. With reference to FIG. 13, this raising zone can also receive an element (60) of the binding by means of a base (61) interacting with the characteristic grooves (12). This base (61) then has a shape which is complementary to the upper part (63) of the raising zone. In particular, this base has two portions (64) forming ribs which come to fit inside the grooves (12) produced on the lateral faces of the ski. It is thus possible to slide the base (61) and therefore the elements of the binding in relation to the ski. The insertion of this base (61) is possible when the characteristic grooves (12) open at the front and/or at the rear of the binding-raising zone or the latter has a narrowing in width allowing the insertion of the ribs (64) into the characteristic grooves (12). Longitudinal locking in position of the binding element (60) is effected by, for example, screwing the base (61) onto the raising zone.

Figure 14:
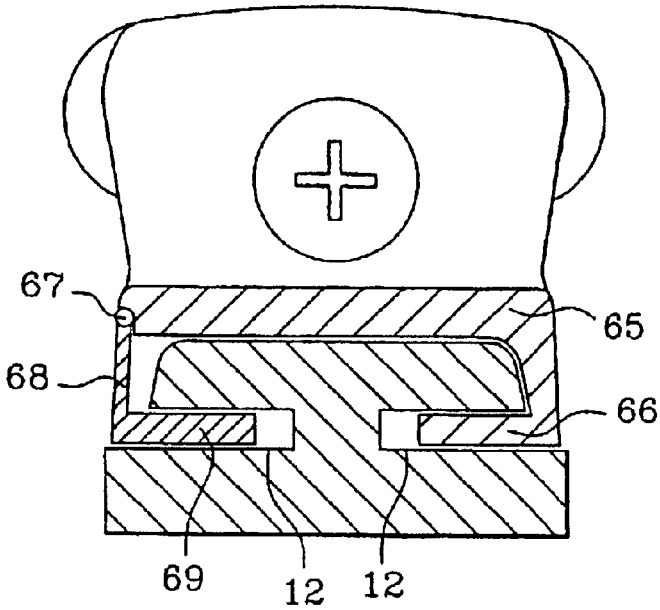

This locking in position can also be achieved, as FIG. 14 illustrates, by using a clamp system including lateral jaws. The base (65) is provided on one side with a rib (66) essentially similar to that illustrated in FIG. 13. On the other side, the base (65) is provided with a mechanism (68) pivoting about a spindle (67) connected to the base. The pivoting piece (68) has a rib (69) which fits in the characteristic groove (12). Elastic means are provided in the region of the pivoting spindle (67) so that the ribs (69 and 66) are laid flat inside the grooves. These locking means can be replaced by a derived device in which the piece (68) enters the grooves by lateral translation, for example under the action of an adjusting screw (not shown). Other means can be envisaged for carrying out the rapid locking of these jaws on the raising zone.

From the above, it emerges that the ski according to the invention has numerous advantages, in particular:

the possibility of adjusting the overall rigidity of the ski by means of the raising zone which forms part of the structure itself of the ski, and the possibility of fitting various types of binding on this same raising zone, in particular bindings having longitudinal adjustability, by sliding in the characteristic grooves.

What is claimed is:

1. A method of manufacturing an alpine ski comprising a binding-raising zone formed by an increased thickness of the structure of the ski, the thickness located in a runner zone of the ski resulting in a projection of a top surface of the ski in the binding raising-zone relative to a sole portion of the ski, wherein the method comprises positioning various component elements of the ski in a mold, between a mold bottom (40) and a mold cover (47), and wherein the method further comprises before molding, extending additional elements (43) into a binding raising zone portion of the mold above the bottom (40) of the mold, between the bottom and the cover (47), and such that the elements pass through each lateral face of the ski;

molding the ski;

after molding, removing the ski from the mold and removing at least a portion of said additional elements (43) from the ski, when the ski is outside the mold, to form grooves (12) in lateral faces of the ski.

2. The method as claimed in claim 1, wherein the additional elements (43) are parallel to the sole of the ski.

3. The method as claimed in claim 1, wherein the additional elements (43) are positioned so as to come into contact with one another.

4. The method as claimed in claim 1, wherein the additional elements come into contact with one another in the central region of the raising zone.

5. The method as claimed in claim 1, wherein the additional elements (43) are removed in totality after molding.

6. The method as claimed in claim 1, wherein the additional elements (55) are removed in part after molding.

7. The method as claimed in claim 6, wherein the additional elements are removed by machining, so as to form the grooves inside the additional elements.

* * * * *